US006512833B2

(12) United States Patent
Himori et al.

(10) Patent No.: US 6,512,833 B2
(45) Date of Patent: Jan. 28, 2003

(54) ELECTRET CONDENSER MICROPHONE AND METHOD OF PRODUCING SAME

(75) Inventors: Tooru Himori, Kanagawa-ken (JP); Yoshinobu Yasuno, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/956,191

(22) Filed: Sep. 19, 2001

(65) Prior Publication Data

US 2002/0057812 A1 May 16, 2002

(30) Foreign Application Priority Data

Sep. 21, 2000 (JP) ..... 2000-287301

(51) Int. Cl.[7] ..... H04R 25/00
(52) U.S. Cl. ..... 381/174; 381/191
(58) Field of Search ..... 381/174, 191, 381/113, 116, 173, 190; 367/170, 181; 29/25.41

(56) References Cited

U.S. PATENT DOCUMENTS 5,272,758 A * 12/1993 Isogami et al. ..... 381/191

* cited by examiner

*Primary Examiner*—Huyen Le

(74) *Attorney, Agent, or Firm*—Pearne & Gordon LLP

(57) ABSTRACT

Herein disclosed is an electret condenser microphone which comprises a casing member having a center axis and including a circular acoustic inlet portion and a cylindrical side portion integrally formed with the acoustic inlet portion, the side portion of the casing member having a first section close to the acoustic inlet portion of the casing member and a second section remote from the acoustic inlet portion of the casing member, the second section of the side portion of the casing member radially inwardly bent toward the center axis of the casing member, a printed circuit board disposed in the casing member and held in contact with the second section of the side portion of the casing member, an electrically insulating member provided on the printed circuit board, an electrode plate provided on the electrically insulating member, and an electrically connecting member intervening between the printed circuit board and the electrode plate to have the printed circuit board and the electrode plate electrically connected with each other.

12 Claims, 10 Drawing Sheets

ELECTRET CONDENSER MICROPHONE AND METHOD OF PRODUCING SAME

BACKGROUND OF THE INVENTION

1. Field of the Invention

The present invention relates to an electret condenser microphone and a method of producing the same available for various audio equipments such as a cellular phone, and more particularly to an electret condenser microphone and a method of producing the same equipped with a condenser unit constituted by an electrode plate and a diaphragm to receive an acoustic wave to be converted to an acoustic signal indicative of the acoustic wave.

2. Description of the Related Art

Up until now, there have been proposed a wide variety of conventional electret condenser microphones each equipped with a condenser unit constituted by an electrode plate and a diaphragm to receive an acoustic wave to be converted to an acoustic signal indicative of the acoustic wave.

The conventional electret condenser microphones of this type have so far been available for various audio equipments such as a cellular phone. One typical example of the conventional electret condenser microphones is exemplified and shown in FIGS. 8 and 9. The conventional electret condenser microphone 900 thus proposed comprises a casing member 910 having a center axis 911. The casing member 910 includes a circular acoustic inlet portion 912, and a cylindrical side portion 913 integrally formed with the acoustic inlet portion 912. The acoustic inlet portion 912 of the casing member 910 has thereon an electret film 916 to constitute an electrode plate. The side portion 913 of the casing member 910 has a first section 914 close to the acoustic inlet portion 912 of the casing member 910, and a second section 915 remote from the acoustic inlet portion 912 of the casing member 910 and radially inwardly bent toward the center axis 911 of the casing member 910.

The conventional electret condenser microphone 900 further comprises a covering member 920 provided on the acoustic inlet portion 912 of the casing member 910, and a printed circuit board 960 disposed in the casing member 910 and spaced apart along the center axis 911 of the casing member 910 from the acoustic inlet portion 912 of the casing member 910. The printed circuit board 960 is partly held in contact with the second section 915 of the side portion 913 of the casing member 910.

The conventional electret condenser microphone 900 further comprises an electrically connecting member 940 provided on the printed circuit board 960, and a diaphragm 930 provided on the electrically connecting member 940. The diaphragm 930 includes a peripheral portion 931 securely retained by the electrically connecting member 940, and a central portion 932 integrally formed with the peripheral portion 931 and radially inwardly extending from the peripheral portion 931 to be partly oscilatable along the center axis 911 of the casing member 910 with respect to the casing member 910. The acoustic inlet portion 912 of the casing member 910 is formed with a plurality of acoustic apertures 917 to have the acoustic wave transmitted to the diaphragm 930 through the covering member 920 and the acoustic apertures 917 of the acoustic inlet portion 912 of the casing member 910. The electrically connecting member 940 is made of a metal and intervenes between the printed circuit board 960 and the peripheral portion 931 of the diaphragm 930 to have the printed circuit board 960 and the peripheral portion 931 of the diaphragm 930 electrically connected with each other.

The conventional electret condenser microphone 900 further comprises an electrically insulating spacer 950 partly intervening between the acoustic inlet portion 912 of the casing member 910 and the diaphragm 930 to have the acoustic inlet portion 912 of the casing member 910 and the diaphragm 930 spaced apart from each other at a predetermined space distance. The acoustic inlet portion 912 of the casing member 910, i.e., the electrode plate, and the diaphragm 930 collectively constitute a condenser unit 933 to generate an electrical capacitance corresponding to the space distance between the acoustic inlet portion 912 of the casing member 910 and the diaphragm 930 when the acoustic wave is transmitted to the diaphragm 930 to have the central portion 932 of the diaphragm 930 partly oscillated along the center axis 911 of the casing member 910 with respect to the casing member 910.

The conventional electret condenser microphone 900 further comprises a signal converting unit 970 including a field effect transistor 971 and designed to convert the electrical capacitance generated by the condenser unit 933 to the acoustic signal indicative of the acoustic wave transmitted to the diaphragm 930. The signal converting unit 970 is provided on the printed circuit board 960 to be electrically connected to the acoustic inlet portion 912 of the casing member 910 through the printed circuit board 960 and the side portion 913 of the casing member 910, and to the diaphragm 930 through the printed circuit board 960 and the electrically connecting member 940.

The following description will be directed to a method of producing the conventional electret condenser microphone 900 with reference to the drawings shown in FIGS. 10A, 10B and 10C. The method of producing the conventional electret condenser microphone 900 is performed through the steps including a preparing step, an imparting step and a releasing step as follows.

In the preparing step, the casing member 910, the covering member 920, the printed circuit board 960, the electrically connecting member 940, the diaphragm 930, the electrically insulating spacer 950, and the signal converting unit 970 are prepared as a partially fabricated unit. The second section 915 of the side portion 913 of the previously mentioned casing member 910 is straightly extends from the first section 914 of the side portion 913 of the casing member 910.

In the imparting step, the second section 915 of the side portion 913 of the casing member 910 is then imparted an external force toward an imparting direction shown by an arrow 901 to assume a first state in which the second section 915 of the side portion 913 of the casing member 910 is bent toward the center axis 911 of the casing member 910 as shown in FIG. 10B.

In the releasing step, the second section 915 of the side portion 913 of the casing member 910 is then released from the external force imparted thereto toward the imparting direction shown by the arrow 901 to assume a second state in which the second section 915 of the side portion 913 of the casing member 910 is naturally elastically restored along the center axis 911 of the casing member 910. The conventional electret condenser microphone 900 is then produced as shown in FIG. 10A.

The conventional electret condenser microphone, however, encounters such a problem that each of the second section 915 of the side portion 913 of the casing member 910 and the electrically connecting member 940 is spaced apart from the printed circuit board 960 in the releasing step as shown in FIG. 10C, resulting from the fact that the second section 915 of the side portion 913 of the casing member 910 is prevented by the electrically connecting member 940 made of a metal from being deformed toward the imparting direction shown by the arrow 901 as shown in FIG. 10B, and the second section 915 of the side portion 913 of the casing member 910 is naturally elastically restored along the center axis 911 of the casing member 910 as shown in FIG. 10C.

The fact that each of the second section of the side portion of the casing member and the electrically connecting member is spaced apart from the printed circuit board leads to the fact that each of the acoustic inlet portion of the casing member, i.e., the electrode plate, and the diaphragm is electrically disconnected from the printed circuit board.

SUMMARY OF THE INVENTION

It is therefore an object of the present invention to provide an electret condenser microphone which is constructed to ensure that each of the electrode plate and the diaphragm is electrically connected with the printed circuit board.

It is another object of the present invention to provide a method of producing an electret condenser microphone which is constructed to ensure that each of the electrode plate and the diaphragm is electrically connected with the printed circuit board.

In accordance with a first aspect of the present invention, there is provided an electret condenser microphone for receiving an acoustic wave to be converted to an acoustic signal indicative of said acoustic wave, comprising: a casing member having a center axis and including a circular acoustic inlet portion and a cylindrical side portion integrally formed with the acoustic inlet portion, the side portion of the casing member having a first section close to the acoustic inlet portion of the casing member and a second section remote from the acoustic inlet portion of the casing member, the second section of the side portion of the casing member radially inwardly bent toward the center axis of the casing member, a printed circuit board disposed in the casing member and held in contact with the second section of the side portion of the casing member, the casing member and the printed circuit board collectively forming a cylindrical casing space; an electrically insulating member accommodated in the casing space and provided on the printed circuit board; an electrode plate provided on the electrically insulating member; and an electrically connecting member intervening between the printed circuit board and the electrode plate to have the printed circuit board and the electrode plate electrically connected with each other.

The outer diameter of the electrically connecting member may be less than the inner diameter of the second section of the side portion of the casing member.

The electrically insulating member may form part of an annular groove open toward the side portion of the casing member, and the inner diameter of the annular groove may be less than the inner diameter of the second section of the side portion of the casing member.

The electret condenser microphone may further comprise a diaphragm supporting member accommodated in the casing space and provided on the acoustic inlet portion of the casing member; and a diaphragm including a peripheral portion securely retained by the diaphragm supporting member and a central portion integrally formed with the peripheral portion and radially inwardly extending from the peripheral portion to be partly oscilatable with respect to the casing member, the diaphragm opposing and spaced apart from the electrode plate at a predetermined space distance.

The electret condenser microphone may further comprise an electrically insulating spacer intervening between the electrode plate and the diaphragm to have the electrode plate and the diaphragm spaced apart from each other at the predetermined space distance.

The electrode plate and the diaphragm may collectively constitute a condenser unit to generate an electrical capacitance corresponding to the space distance between the electrode plate and the diaphragm when the acoustic wave is transmitted to the diaphragm to have the central portion of the diaphragm partly oscillated with respect to the casing member.

The electret condenser microphone may further comprise signal converting means for converting the electrical capacitance generated by the condenser unit to the acoustic signal indicative of the acoustic wave transmitted to the diaphragm.

The signal converting means may include a field effect transistor, a chip capacitor and a resistor.

The electret condenser microphone may further comprise a covering member provided on the acoustic inlet portion of the casing member.

The electrode plate may have thereon an electret film.

In accordance with a second aspect of the present invention, there is provided a method of producing an electret condenser microphone, comprising the steps of: preparing a partially fabricated unit comprising a casing member having a center axis and including a circular acoustic inlet portion and a cylindrical side portion integrally formed with the acoustic inlet portion, the side portion of the casing member having a first section close to the acoustic inlet portion of the casing member and a second section remote from the acoustic inlet portion of the casing member, a printed circuit board disposed in the casing member and spaced apart from the acoustic inlet portion of the casing member, the casing member and the printed circuit board collectively forming a cylindrical casing space, an electrically insulating member accommodated in the casing space and provided on the printed circuit board, an electrode plate provided on the electrically insulating member, an electrically connecting member intervening between the printed circuit board and the electrode plate to have the printed circuit board and the electrode plate electrically connected with each other; imparting an external force to the second section of the side portion of the casing member to assume a first state in which the second section of the side portion of the casing member is bent toward the center axis of the casing member to the extent that the electrically insulating member is forcibly elastically deformed along the center axis of the casing member; and releasing the second section of the side portion of the casing member from the external force imparted thereto to assume a second state in which the second section of the side portion of the casing member is naturally elastically restored along the center axis of the casing member to the extent that the electrically insulating member is naturally elastically restored along the center axis of the casing member.

The electrically insulating member may be made of a resin.

BRIEF DESCRIPTION OF THE DRAWINGS

The objects, features and advantages of the present invention will become apparent as the description proceeds when taken in conjunction with the accompanying drawings, in which.

DESCRIPTION OF THE PREFERRED EMBODIMENTS

The first preferred embodiment of the electret condenser microphone according to the present invention will now be described in detail in accordance with the accompanying drawings.

Figure 1:
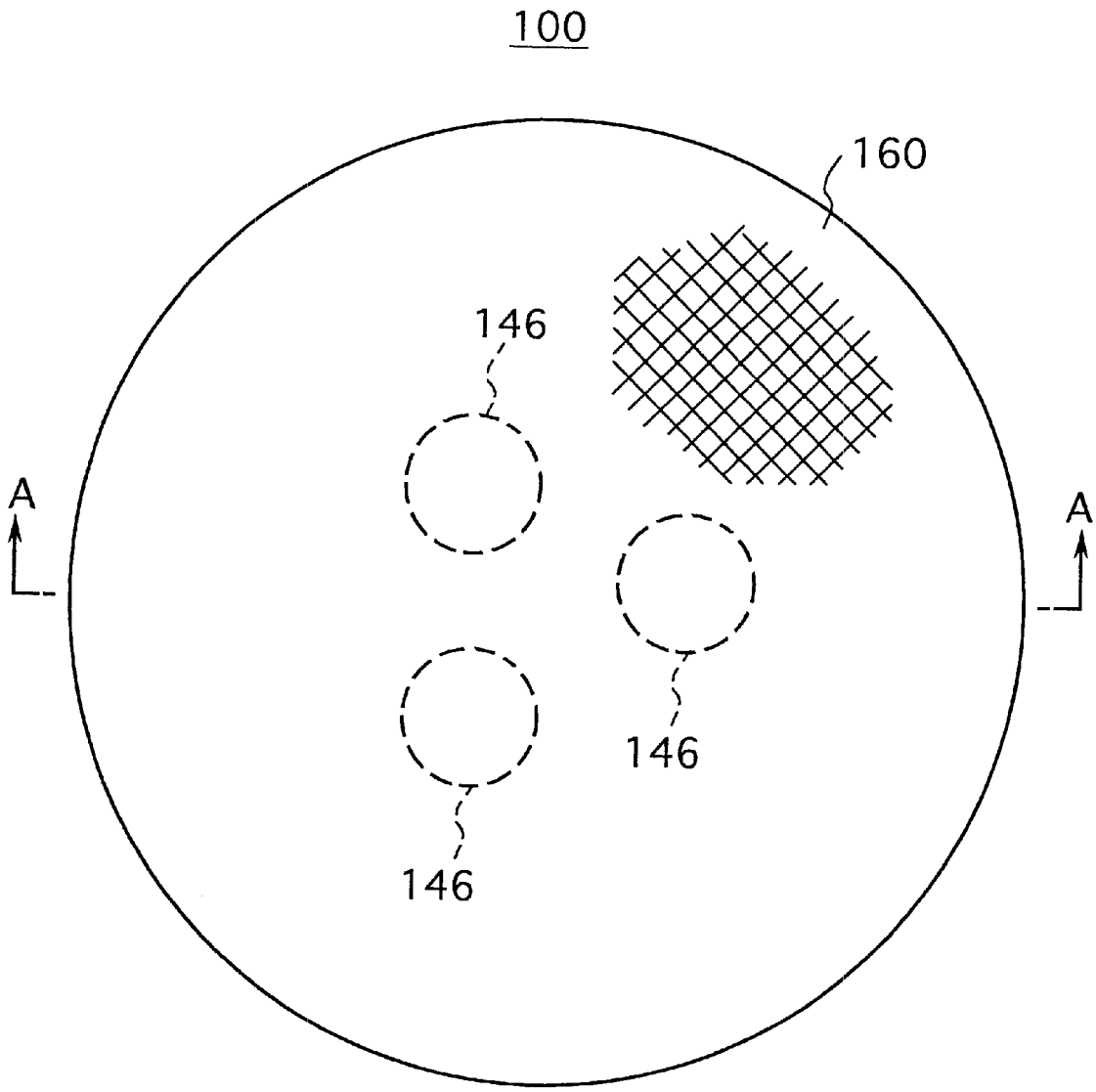
FIG. 1 is a plan view of a first embodiment of the electret condenser microphone according to the present invention.
Figure 2:
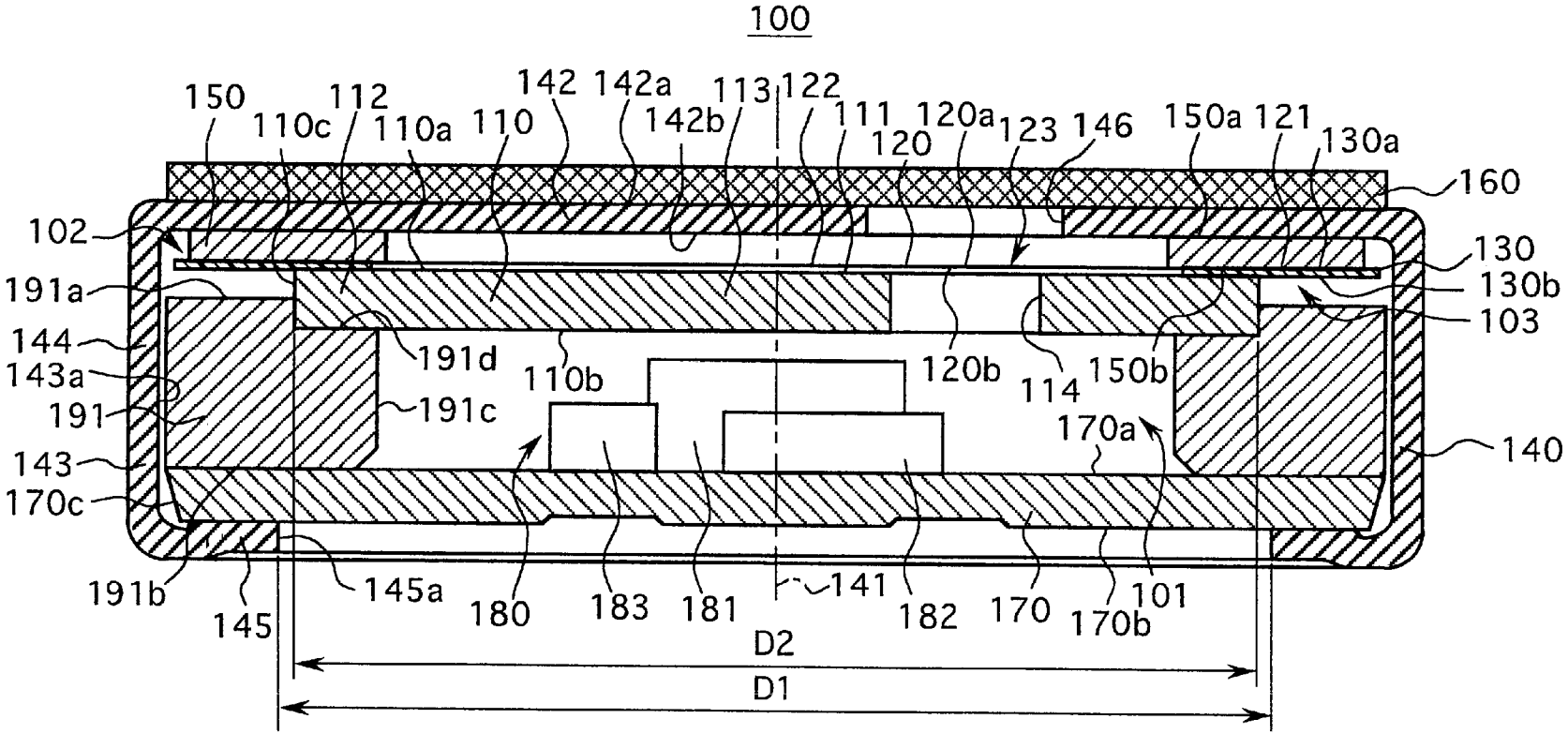
FIG. 2 is a cross-sectional view taken along the line A—A of FIG. 1.

Referring now to the drawings, in particular to FIGS. 1 to 3, there is shown the first preferred embodiment of the electret condenser microphone according to the present invention. The electret condenser microphone 100 is designed to receive an acoustic wave to be converted to an acoustic signal indicative of the acoustic wave. The electret condenser microphone 100 comprises a casing member 140 in the form of a cylindrical shape and having a center axis 141. The casing member 140 includes a circular acoustic inlet portion 142 having first and second circular surfaces 142*a* and 142*b*, and a cylindrical side portion 143 integrally formed with the acoustic inlet portion 142 of the casing member 140 and having a cylindrical inner surface 143*a* connected with the second surface 142*b* of the acoustic inlet portion 142 of the casing member 140. The side portion 143 of the casing member 140 has a first section 144 close to the acoustic inlet portion 142 of the casing member 140, and a second section 145 remote from the acoustic inlet portion 142 of the casing member 140 and having an end surface 145*a*. The second section 145 of the side portion 143 of the casing member 140 is radially inwardly bent toward the center axis 141 of the casing member 140. The casing member 140 is made of an electrically conductive material.

The electret condenser microphone 100 further comprises a printed circuit board 170 in the form of a circular shape and disposed in the casing member. The printed circuit board 170 is held in coaxial alignment with the casing member 140. The printed circuit board 170 has a first circular surface 170*a* opposing and spaced apart along the center axis 141 of the casing member 140 from the second surface 142*b* of the acoustic inlet portion 142 of the casing member 140, a second circular surface 170*b* partly held in contact with the second section 145 of the side portion 143 of the casing member 140, and a peripheral surface 170*c* spaced apart from the inner surface 143*a* of the side portion 143 of the casing member 140. Each of the first and second surface 170*a* and 170*b* of the printed circuit board 170 has thereon a printed wiring. The casing member 140 and the printed circuit board 170 collectively form a cylindrical casing space 102.

The electret condenser microphone 100 further comprises an electrically connecting member 191 in the form of an annular ring shape and accommodated in the casing space 102. The electrically connecting member 191 is provided on the first surface 170*a* of the printed circuit board 170. The electrically connecting member 191 has a first annular surface 191*a* opposing and spaced apart along the center axis 141 of the casing member 140 from the second surface 142*b* of the acoustic inlet portion 142 of the casing member 140, a second annular surface 191*b* held in contact with the first surface 170*a* of the printed circuit board 170, and a cylindrical inner surface 191*c* formed with a annular ledge 191*d* connected with the first surface 191*a* of the electrically connecting member 191. The electrically connecting member 191 is made of an electrically conductive material.

The electret condenser microphone 100 further comprises an electrode plate 110 in the form of a circular shape and provided on the electrically connecting member 191. The electrode plate 110 is held in coaxial alignment with the casing member 140. The electrode plate 110 includes a peripheral portion 112 securely retained by the annular ledge 191*d* of the electrically connecting member 191, and a central portion 113 integrally formed with the peripheral portion 112 and radially inwardly extending from the peripheral portion 112. The electrode plate 110 has a first circular surface 110*a* opposing and spaced apart along the center axis 141 of the casing member 140 from the second surface 142*b* of the acoustic inlet portion 142 of the casing member 140, a second circular surface 110*b* opposing and spaced apart along the center axis 141 of the casing member 140 from the first surface 170*a* of the printed circuit board 170, and a peripheral surface 110*c* spaced apart from the inner surface 143*a* of the side portion 143 of the casing member 140. The first surface 110*a* of the electrode plate 110 has thereon an electret film 111 opposing and spaced apart along the center axis 141 of the casing member 140 from the second surface 142*b* of the acoustic inlet portion 142 of the casing member 140. The electrode plate 110 is formed with a penetrating hole 114 open at the first and second surfaces 110*a* and 110*b* of electrode plate 110. The electrode plate 110 is made of an electrically conductive material.

The electrically connecting member 191 intervenes between the printed circuit board 170 and the peripheral portion 112 of the electrode plate 110 to have the printed circuit board 170 and the peripheral portion 112 of the electrode plate 110 electrically connected with each other. The inner surface 191*c* of the electrically a connecting member 191 is connected at one end with the second surface 110*b* of the electrode plate 110 and at the other end with the first surface 170*a* of the printed circuit board 170. The inner surface 191*c* of the electrically connecting member 191, the second surface 110*b* of the electrode plate 110 and the first surface 170*a* of the printed circuit board 170 collectively define a cylindrical housing space 101.

The electret condenser microphone 100 further comprises a diaphragm supporting member 150 in the form of an annular ring shape and accommodated in the casing space 102. The diaphragm supporting member 150 is provided on the second surface 142*b* of the acoustic inlet portion 142 of the casing member 140. The diaphragm supporting member 150 has a first annular surface 150*a* held in contact with the second surface 142*b* of the acoustic inlet portion 142 of the casing member 140, and a second annular surface 150*b* opposing and spaced apart along the center axis 141 of the casing member 140 from the first surface 170*a* of the printed circuit board 170. The diaphragm supporting member 150 is made of an electrically conductive material.

The electret condenser microphone 100 further comprises a diaphragm 120 in the form of a circular shape and provided on the diaphragm supporting member 150. The diaphragm 120 is held in coaxial alignment with the casing member 140. The diaphragm 120 includes a peripheral portion 121 securely retained by the second surface 150*b* of the diaphragm supporting member 150, and a central portion 122 integrally formed with the peripheral portion 121 and radially inwardly extending from the peripheral portion 121 to be partly oscillatable along the center axis 141 of the casing member 140 with respect to the casing member 140. The diaphragm 120 has a first circular surface 120*a* opposing and spaced apart along the center axis 141 of the casing member 140 from the second surface 142*b* of the acoustic inlet portion 142 of the casing member 140, and a second circular surface 120*b* opposing and spaced apart along the center axis 141 of the casing member 140 from the first surface 110*a* of the electrode plate 110 at a predetermined space distance. The diaphragm 120 is made of an electrically conductive material.

The electrode plate 110 and the diaphragm 120 collectively constitute a condenser unit 123 to generate an electrical capacitance corresponding to the space distance between the electrode plate 110 and the diaphragm 120 when the acoustic wave is transmitted to the diaphragm 120 to have the central portion 122 of the diaphragm 120 partly oscillated along the center axis 141 of the casing member 140 with respect to the casing member 140.

The electret condenser microphone 100 further comprises an electrically insulating spacer 130 in the form of an annular ring shape and partly intervening between the first surface 110*a* of the electrode plate 110 and the second surface 120*b* of the diaphragm 120 to have the first surface 110*a* of the electrode plate 110 and the second surface 120*b* of the diaphragm 120 spaced apart from each other at the predetermined space distance. The electrically insulating spacer 130 has a first annular surface 130*a* held in contact with the second surface 120*b* of the diaphragm 120, and a second annular surface 130*b* partly held in contact with the first surface 110*a* of the electrode plate 110 and partly opposing and spaced apart along the center axis 141 of the casing member 140 from the first surface 191*a* of the electrically connecting member 191. The second surface 130*b* of the electrically insulating spacer 130, the first surface 191*a* of the electrically connecting member 191 and the peripheral surface 110*c* of the electrode plate 110 collectively form an annular groove 103 open toward the side portion 143 of the casing member 140. The electrically insulating spacer 130 is made of an electrically insulating material.

In the first embodiment of the electret condenser microphone according to the present invention, the inner diameter D2 of the annular groove 103, i.e., the outer diameter D2 of the peripheral surface 110*c* of the electrode plate 110, is less than the inner diameter D1 of the second section 145 of the side portion 143 of the casing member 140, i.e., the inner diameter D1 of the end surface 145*a* of the second section 145 of the side portion 143 of the casing member 140.

The electret condenser microphone 100 further comprises a covering member 160 in the form of a circular shape and provided on the first surface 142*a* of the acoustic inlet portion 142 of the casing member 140. The covering member 160 is made of a cloth. The acoustic inlet portion 142 of the casing member 140 is formed with a plurality of acoustic apertures 146 open at the first and second surfaces 142*a* and 142*b* of the acoustic inlet portion 142 of the casing member 140 to have the acoustic wave transmitted to the diaphragm 120 through the covering member 160 and the acoustic apertures 146 of the acoustic inlet portion 142 of the casing member 140.

The electret condenser microphone 100 further comprises signal converting means which is constituted by a signal converting unit 180. The signal converting unit 180 is designed to convert the electrical capacitance generated by the condenser unit 123 to the acoustic signal indicative of the acoustic wave transmitted to the diaphragm 120. The signal converting unit 180 is accommodated in the housing space 101 and provided on the first surface 170*a* of the printed circuit board 170. The signal converting unit 180 is electrically connected to the electrode plate 110 through the printed circuit board 170 and the electrically connecting member 191, and to the diaphragm 120 through the printed circuit board 170, the casing member 140 and the diaphragm 120 supporting member 150. The signal converting unit 180 includes a field effect transistor 181, a chip capacitor 182 and a resistor 183.

The electrically connecting member 191, the electrode plate 110, the diaphragm supporting member 150, the diaphragm 120, the electrically insulating spacer 130, and the signal converting unit 180 collectively constitute an interior component accommodated in the casing space 102.

Figure 3C:
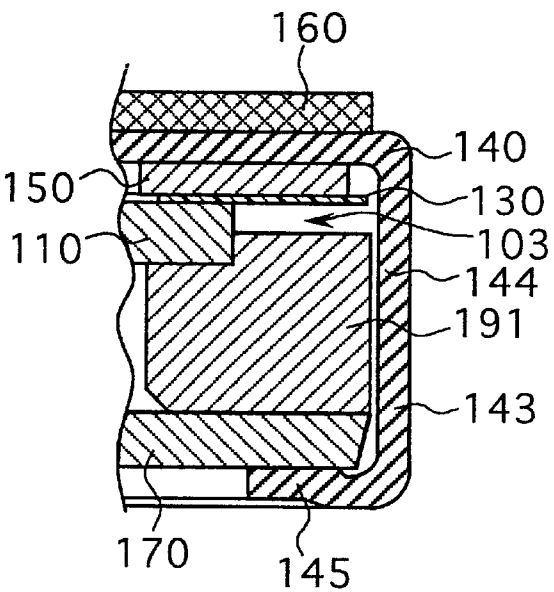
FIG. 3C is an enlarged fragmentary cross-sectional view similar to FIG. 3A but showing an external force releasing step performed by the electret condenser microphone shown in FIG. 2.
Figure 3B:
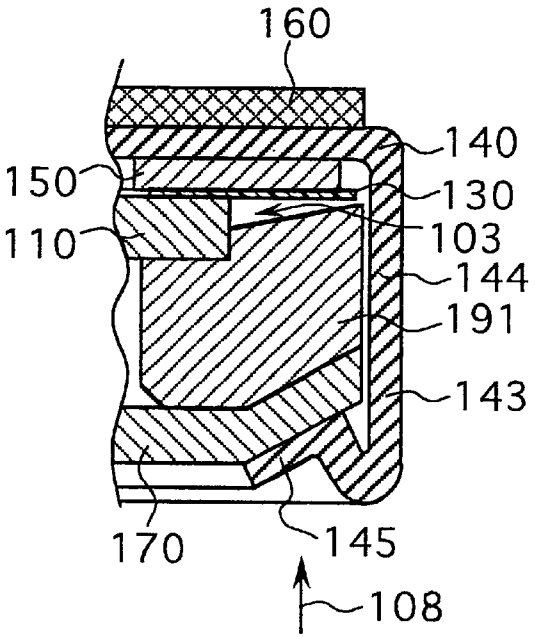
FIG. 3B is an enlarged fragmentary cross-sectional view similar to FIG. 3A but showing an external force imparting step performed by the electret condenser microphone shown in FIG. 2.
Figure 3A:
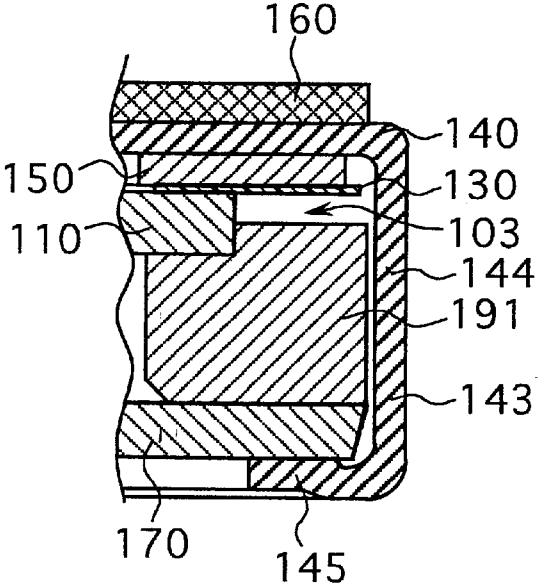
FIG. 3A is an enlarged fragmentary cross-sectional view of the electret condenser microphone shown in FIG. 2.

The following description will be directed to a method of producing the electret condenser microphone 100 with reference to the drawings shown in FIGS. 3A, 3B and 3C. The method of producing the electret condenser microphone 100 is performed through the steps including a preparing step, an imparting step and a releasing step as follows.

In the preparing step, the casing member 140, the printed circuit board 170, the electrically connecting member 191, the electrode plate 110, the diaphragm supporting member 150, the diaphragm 120, the electrically insulating spacer 130, the covering member 160, and the signal converting unit 180 are prepared as a partially fabricated unit. The constructions of the casing member 140, the printed circuit board 170, the electrically connecting member 191, the electrode plate 110, the diaphragm supporting member 150, the diaphragm 120, the electrically insulating spacer 130, the covering member 160, and the signal converting unit 180 have been described in the above as will be seen in FIG. 2. The second section 145 of the side portion 143 of the previously mentioned casing member 140, however, is straightly extends from the first section 144 of the side portion 143 of the casing member 140 before the imparting step.

In the imparting step, the second section 145 of the side portion 143 of the casing member 140 is then imparted an external force toward an imparting direction shown by an arrow 108 to assume a first state in which the second section 145 of the side portion 143 of the casing member 140 is bent toward the center axis 141 of the casing member 140 to the extent that the electrically connecting member 191 is forcibly elastically deformed along the center axis 141 of the casing member 140 with the annular groove 103 being reduced in space as shown in FIG. 3B. For the purpose of assisting in understanding, the deformations of the casing member 140, the printed circuit board 170 and the electrically connecting member 191 are illustrated in an exaggerated manner in FIG. 3B as being larger than the real deformations of the casing member 140, the printed circuit board 170 and the electrically connecting member 191.

In the releasing step, the second section 145 of the side portion 143 of the casing member 140 is then released from the external force imparted thereto toward the imparting direction shown by the arrow 108 to assume a second state in which the second section 145 of the side portion 143 of the casing member 140 is naturally elastically restored along the center axis 141 of the casing member 140 to the extent that the electrically connecting member 191 is naturally elastically restored along the center axis 141 of the casing member 140 with the annular groove 103 being restored in space as shown in FIG. 3C.

The electret condenser microphone 100 is then ideally produced to have each of the second section 145 of the side portion 143 of the casing member 140 and the electrically connecting member 191 held in contact with the printed circuit board 170 under a high contact pressure between the second section 145 of the side portion 143 of the casing member 140 and the printed circuit board 170 as shown in FIG. 3A. The fact that each of the second section 145 of the side portion 143 of the casing member 140 and the electrically connecting member 191 is held in contact with the printed circuit boar, 170 under the high contact pressure between the second section 145 of the side portion 143 of the casing member 140 and the printed circuit board 170 leads to the fact that each of the electrode plate 110 and the diaphragm 120 is electrically connected with the printed circuit board 170 with reliability.

As will be seen from the foregoing description, the fact that the electrically connecting member intervenes between the printed circuit board and the electrode plate to form part of the annular groove leads to the fact that the first embodiment of the electret condenser microphone according to the present invention makes it possible that each of the electrode plate and the diaphragm is electrically connected with the printed circuit board with reliability.

While the electret condenser microphone 100 has been described in the above as comprising the electrically connecting member 191 intervening between the printed circuit board 170 and the electrode plate 110 as shown in FIG. 2, the electrically connecting member 191 may be replaced by an electrically insulating member and an electrically connecting member each intervening between the printed circuit board 170 and the electrode plate 110 according to the present invention.

Figure 4:
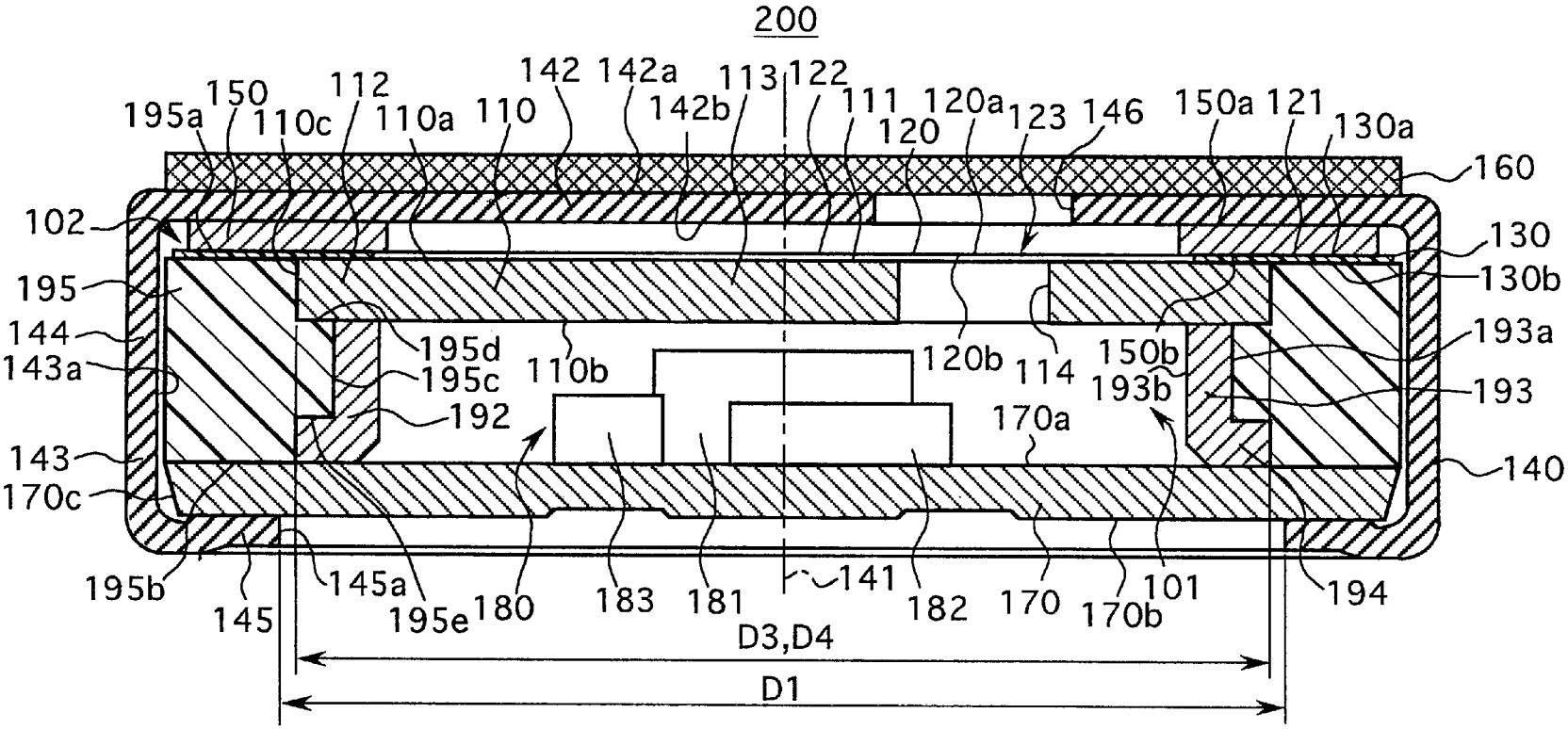
FIG. 4 is a cross-sectional view taken along the line A—A of FIG. 1 but showing a second embodiment of the electret condenser microphone according to the present invention.

The second embodiment directed to an electrically insulating member and an electrically connecting member each intervening between the printed circuit board 170 and the electrode plate 110 is shown in FIGS. 4 and 5.

In FIG. 4, the electret condenser microphone 200 comprises an electrically insulating member 195 in the form of an annular ring shape and accommodated in the casing space 102. The electrically insulating member 195 is provided on the first surface 170*a* of the printed circuit board 170. The electrically insulating member 195 has a first annular surface 195*a* opposing and spaced apart along the center axis 141 of the casing member 140 from the second surface 142*b* of the acoustic inlet portion 142 of the casing member 140, a second annular surface 195*b* held in contact with the first surface 170*a* of the printed circuit board 170, and a cylindrical inner surface 195*c* formed at one end with a first annular ledge 195*d* connected with the first surface 195*a* of the electrically insulating member 195 and at the other end with a second annular ledge 195*e* connected with the second surface 195*b* of the electrically insulating member 195. The electrically insulating member 195 is made of a resin, preferably selected from the group consisting of a polybutylene terephthalate and a liquid crystal polymer.

The electrode plate 110 is provided on the electrically insulating member 195. The peripheral portion 112 of the electrode plate 110 is securely retained by the first annular ledge 195*d* of the electrically insulating member 195. This means that the electrically insulating member 195 intervenes between the printed circuit board 170 and the peripheral portion 112 of the electrode plate 110. The first surface 195*a* of the electrically insulating member 195 is flush with the first surface 110*a* of the electrode plate 110.

The electret condenser microphone 200 further comprises an electrically connecting member 192 in the form of an annular ring shape and intervening between the printed circuit board 170 and the peripheral portion 112 of the electrode plate 110 to have the printed circuit board 170 and the peripheral portion 112 of the electrode plate 110 electrically connected with each other. The electrically connecting member 192 includes an annular ring portion 193, and a flange portion 194 integrally formed with the ring portion 193 and radially outwardly extending from the ring portion 193. The ring portion 193 of the electrically connecting member 192 has a peripheral surface 193*a* held in contact with the inner surface 195*c* of the electrically insulating member 195, and a inner surface 193*b* connected at one end with the second surface 110*b* of the electrode plate 110 and at the other end with the first surface 170*a* of the printed circuit board 170. The flange portion 194 of the electrically connecting member 192 is securely retained by the second annular ledge 195*e* of the electrically insulating member 195. The inner surface 193*b* of the ring portion 193 of the electrically connecting member 192, the second surface 110*b* of the electrode plate 110 and the first surface 170*a* of the printed circuit board 170 collectively define a cylindrical housing space 101.

The second surface 130*b* of the electrically insulating spacer 130 is partly held in contact with each of the first surface 110*a* of the electrode plate 110 and the first surface 195a of the electrically insulating member 195.

In the second embodiment of the electret condenser microphone according to the present invention, the inner diameter D3 of the first annular ledge 195*d* of the electrically insulating member 195, i.e., the outer diameter D3 of the peripheral surface 110*c* of the electrode plate 110, is less than the inner diameter D1 of the second section 145 of the side portion 143 of the casing member 140, i.e., the inner diameter D1 of the end surface 145*a* of the second section 145 of the side portion 143 of the casing member 140. In addition, the inner diameter D4 of the second annular ledge 195*e* of the electrically insulating member 195, i.e., the outer diameter D4 of the flange portion 194 of the electrically connecting member 192, is less than the inner diameter D1 of the second section 145 of the side portion 143 of the casing member 140, i.e., the inner diameter D1 of the end surface 145*a* of the second section 145 of the side portion 143 of the casing member 140.

The signal converting unit 180 is electrically connected to the electrode plate 110 through the printed circuit board 170 and the electrically connecting member 192, and to the diaphragm 120 through the printed circuit board 170, the casing member 140 and the diaphragm 120 supporting member 150.

The electrically insulating member 195, the electrically connecting member 192, the electrode plate 110, the diaphragm supporting member 150, the diaphragm 120, the electrically insulating spacer 130, and the signal converting unit 180 collectively constitute an interior component accommodated in the casing space 102.

The above description of the second embodiment has been made only about the electrically insulating member 195 and the electrically connecting member 192 different from those of the first embodiment, but has not been directed to the casing member 140, the printed circuit board 170, the electrode plate 110, the diaphragm supporting member 150, the diaphragm 120, the electrically insulating spacer 130, the covering member 160 and the signal converting unit 180 which are entirely the same as those of the first embodiment. Detailed description about the casing member 140, the printed circuit board 170, the electrode plate 110, the diaphragm supporting member 150, the diaphragm 120, the electrically insulating spacer 130, the covering member 160 and the signal converting unit 180 will therefore be omitted hereinafter.

Figure 5C:
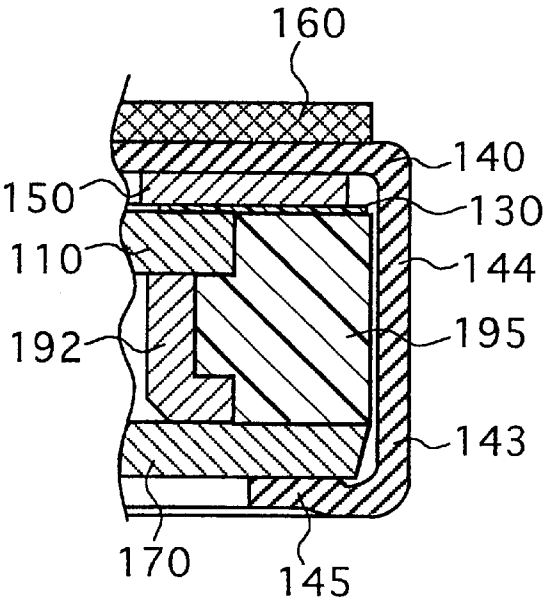
FIG. 5C is an enlarged fragmentary cross-sectional view similar to FIG. 5A but showing an external force releasing step performed by the electret condenser microphone shown in FIG. 4.
Figure 5B:
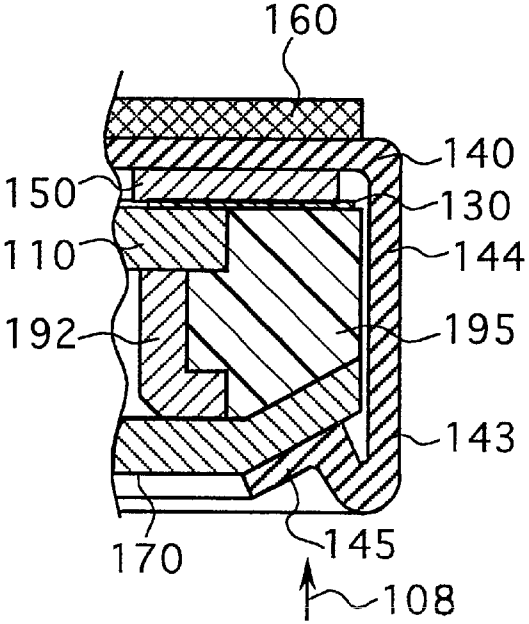
FIG. 5B is an enlarged fragmentary cross-sectional view similar to FIG. 5A but showing an external force imparting step performed by the electret condenser microphone shown in FIG. 4.
Figure 5A:
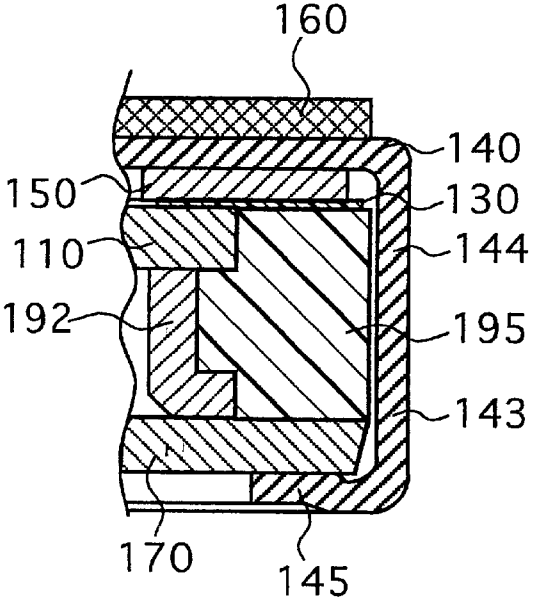
FIG. 5A is an enlarged fragmentary cross-sectional view of the electret condenser microphone shown in FIG. 4.

The following description will be directed to a method of producing the electret condenser microphone 200 with reference to the drawings shown in FIGS. 5A, 5B and 5C. The method of producing the electret condenser microphone 200 is performed through the steps including a preparing step, an imparting step and a releasing step as follows.

In the preparing step, the casing member 140, the printed circuit board 170, the electrically insulating member 195, the electrode plate 110, the electrically connecting member 192, the diaphragm supporting member 150, the diaphragm 120, the electrically insulating spacer 130, the covering member 160, and the signal converting unit 180 are prepared as a partially fabricated unit. The constructions of the casing member 140, the printed circuit board 170, the electrically insulating member 195, the electrode plate 110, the electrically connecting member 192, the diaphragm supporting member 150, the diaphragm 120, the electrically insulating spacer 130, the covering member 160, and the signal converting unit 180 have been described in the above as will be seen in FIG. 4. The second section 145 of the side portion 143 of the previously mentioned casing member 140, however, is straightly extends from the first section 144 of the side portion 143 of the casing member 140 before the imparting step.

In the imparting step, the second section 145 of the side portion 143 of the casing member 140 is then imparted an external force toward an imparting direction shown by an arrow 108 to assume a first state in which the second section 145 of the side portion 143 of the casing member 140 is bent toward the center axis 141 of the casing member 140 to the extent that the electrically insulating member 195 is forcibly elastically deformed along the center axis 141 of the casing member 140 as shown in FIG. 5B. For the purpose of assisting in understanding, the deformations of the casing member 140, the printed circuit board 170 and the electrically insulating member 195 are illustrated in an exaggerated manner in FIG. 5B as being larger than the real deformations of the casing member 140 the printed circuit board 170 and the electrically insulating member 195.

In the releasing step, the second section 145 of the side portion 143 of the casing member 140 is then released from the external force imparted thereto toward the imparting direction shown by the arrow 108 to assume a second state in which the second section 145 of the side portion 143 of the casing member 140 is naturally elastically restored along the center axis 141 of the casing member 140 to the extent that the electrically insulating member 195 is naturally elastically restored along the center axis 141 of the casing member 140 as shown in FIG. 5C.

The electret condenser microphone 200 is then ideally produced to have each of the second section 145 of the side portion 143 of the casing member 140 and the electrically connecting member 192 held in contact with the printed circuit board 170 under a high contact pressure between the second section 145 of the side portion 143 of the casing member 140 and the printed circuit board 170 as shown in FIG. 5A. The fact that each of the second section 145 of the side portion 143 of the casing member 140 and the electrically connecting member 192 is held in contact with the printed circuit board 170 under the high contact pressure between the second section 145 of the side portion 143 of the casing member 140 and the printed circuit board 170 leads to the fact that each of the electrode plate 110 and the diaphragm 120 is electrically connected with the printed circuit board 170 with reliability.

As will be seen from the foregoing description, the fact that the electrically insulating member intervenes between the printed circuit board and the electrode plate leads to the fact that the second embodiment of the electret condenser microphone according to the present invention makes it possible that each of the electrode plate and the diaphragm is electrically connected with the printed circuit board with reliability. In addition, the fact that the outer diameter of the flange portion of the electrically connecting member is less than the inner diameter of the second section of the side portion of the casing member leads to the fact that the second embodiment of the electret condenser microphone according to the present invention makes it possible that each of the electrode plate and the diaphragm is electrically connected with the printed circuit board with no deformation of the electrically connecting member.

While it has been described in the foregoing embodiment that the electrically connecting member is in the form of an annular ring shape, the electrically connecting member may be in the form of any other shape as long as the electrically connecting member can intervene between the printed circuit board and the electrode plate to have the printed circuit board and the electrode plate electrically connected with each other according to the present invention.

Though it has been described in the foregoing embodiment that the electrically insulating member is made of a resin, the electrically. insulating member may be made of any other material having a larger elasticity than a metal according to the present invention.

While the electret condenser microphone 200 has been described in the above as comprising the electrically insulating member 195 intervening between the printed circuit board 170 and the electrode plate 110 to be held in contact with the electrically insulating spacer 130 as shown in FIG. 4, the electrically insulating member 195 may be replaced by an electrically insulating member intervening between the printed circuit board 170 and the electrode plate 110 to partly form the annular grove 103 according to the present invention.

Figure 6:
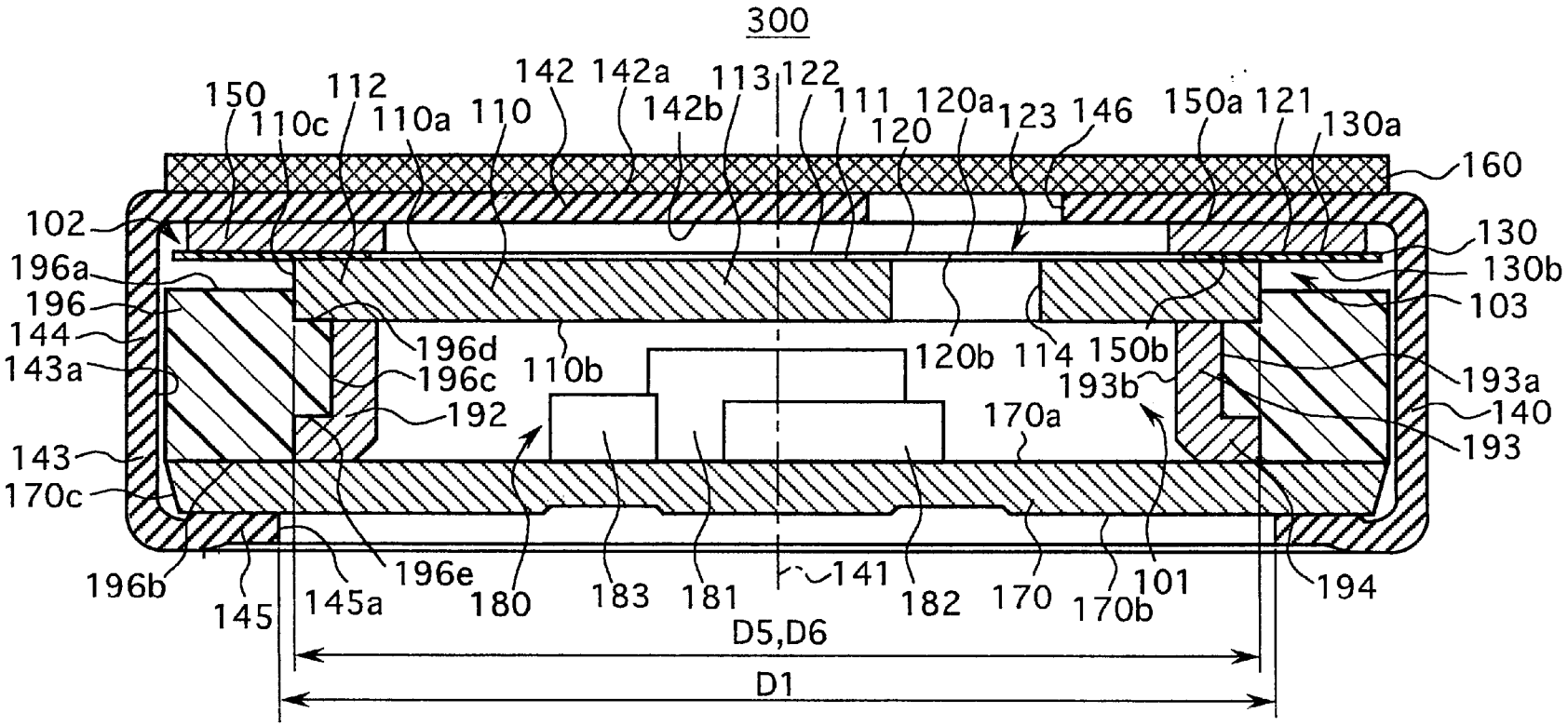
FIG. 6 is a cross-sectional view taken along the line A—A of FIG. 1 but showing a third embodiment of the electret condenser microphone according to the present invention.

The third embodiment directed to an electrically insulating member intervening between the printed circuit board 170 and the electrode plate 110 to partly form the annular grove 103 is shown in FIGS. 6 and 7.

In FIG. 6, the electret condenser microphone 300 comprises an electrically insulating member 196 in the form of an annular ring shape and accommodated in the casing space 102. The electrically insulating member 196 is provided on the first surface 170*a* of the printed circuit board 170. The electrically insulating member 196 has a first annular surface 196*a* opposing and spaced apart along the center axis 141 of the casing member 140 from the second surface 142*b* of the acoustic inlet portion 142 of the casing member 140, a second annular surface 196*b* held in contact with the first surface 170*a* of the printed circuit board 170, and a cylindrical inner surface 196*c* formed at one end with a first annular ledge 196*d* connected with the first surface 196*a* of the electrically insulating member 196 and at the other end with a second annular ledge 196*e* connected with the second surface 196*b* of the electrically insulating member 196. The electrically insulating member 196 is made of a resin, preferably selected from the group consisting of a polybutylene terephthalate and a liquid crystal polymer.

The electrode plate 110 is provided on the electrically insulating member 196. The peripheral portion 112 of the electrode plate 110 is securely retained by the first annular ledge 196*d* of the electrically insulating member 196. This means that the electrically insulating member 196 intervenes between the printed circuit board 170 and the peripheral portion 112 of the electrode plate 110.

The peripheral surface 193*a* of the ring portion 193 of the electrically connecting member 192 is held in contact with the inner surface 196*c* of the electrically insulating member 196. The flange portion 194 of the electrically connecting member 192 is securely retained by-the second annular ledge 196*e* of the electrically insulating member 196.

The second surface 130*b* of the electrically insulating spacer 130 is partly held in contact with the first surface 110*a* of the electrode plate 110 and partly opposing and spaced apart along the center axis 141 of the casing member 140 from the first surface 196*a* of the electrically insulating member 196. The second surface 130*b* of the electrically insulating spacer 130, the first surface 196*a* of the electrically insulating member 196 and the peripheral surface 110*c* of the electrode plate 110 collectively form an annular groove 103 open toward the side portion 143 of the casing member 140.

In the third embodiment of the electret condenser microphone according to the present invention, the inner diameter D5 of the annular groove 103, i.e., the outer diameter D5 of the peripheral surface 10c of the electrode plate 110, is less than the inner diameter D1 of the second section 145 of the side portion 143 of the casing member 140, i.e., the inner diameter D1 of the end surface 145*a* of the second section 145 of the side portion 143 of the casing member 140. In addition, the inner diameter D6 of the second annular ledge 196*e* of the electrically insulating member 196, i.e., the outer diameter D6 of the flange portion 194 of the electrically connecting member 192, is less than the inner diameter D1 of the second section 145 of the side portion 143 of the casing member 140, i.e., the inner diameter D1 of the end surface 145a of the second section 145 of the side portion 143 of the casing member 140.

The electrically insulating member 196, the electrically connecting member 192, the electrode plate 110, the diaphragm supporting member 150, the diaphragm 120, the electrically insulating spacer 130, and the signal converting unit 180 collectively constitute an interior component accommodated in the casing space 102.

The above description of the third embodiment has been made only about the electrically insulating member 196 different from those of the second embodiment, but has not been directed to the casing member 140, the printed circuit board 170, the electrode plate 110, the electrically connecting member 192, the diaphragm supporting member 150, the diaphragm 120, the electrically insulating spacer 130, the covering member 160 and the signal converting unit 180 which are entirely the same as those of the second embodiment. Detailed description about the casing member 140, the printed circuit board 170, the electrode plate 110, the electrically connecting member 192, the diaphragm supporting member 150, the diaphragm 120, the electrically insulating spacer 130, the covering member 160 and the signal converting unit 180 will therefore be omitted hereinafter.

Figures 7A, 7B, 7C:
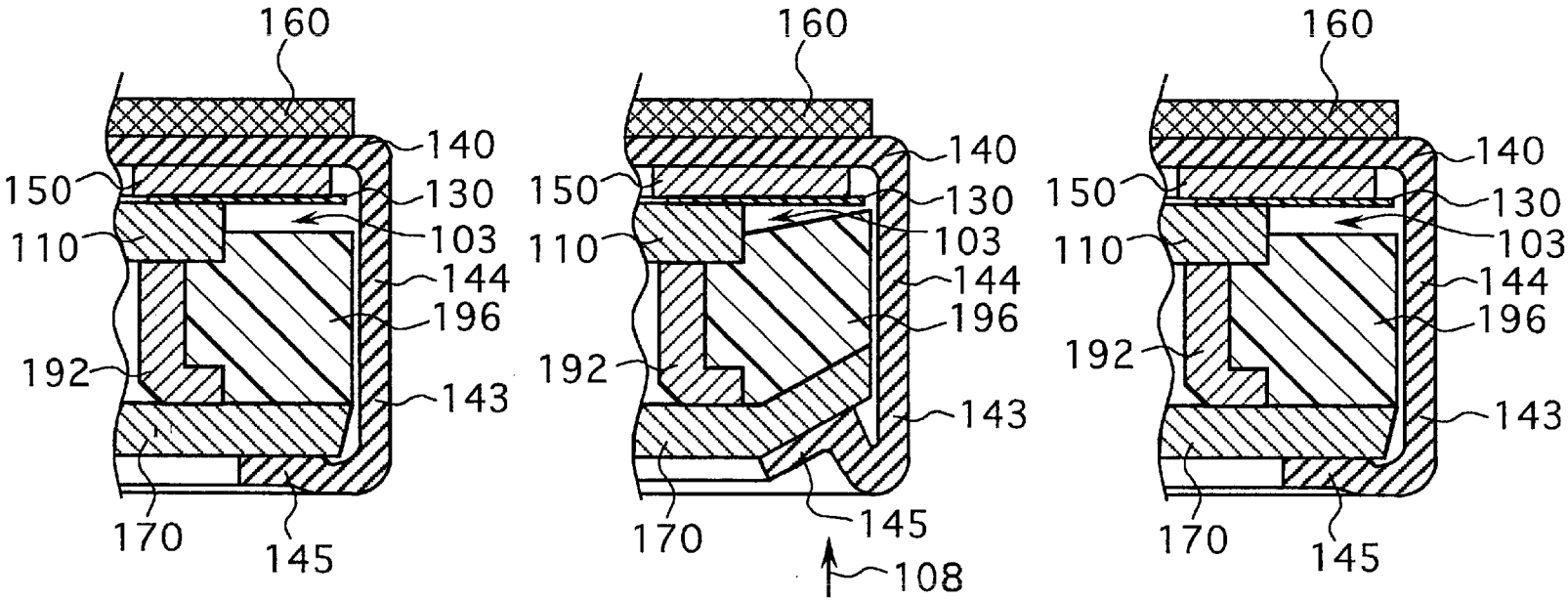
FIG. 7A is an enlarged fragmentary cross-sectional view of the electret condenser microphone shown in FIG. 6.
FIG. 7B is an enlarged fragmentary cross-sectional view similar to FIG. 7A but showing an external force imparting step performed by the electret condenser microphone shown in FIG. 6.
FIG. 7C is an enlarged fragmentary cross-sectional view similar to FIG. 7A but showing an external force releasing step performed by the electret condenser microphone shown in FIG. 6.
Figure 8:
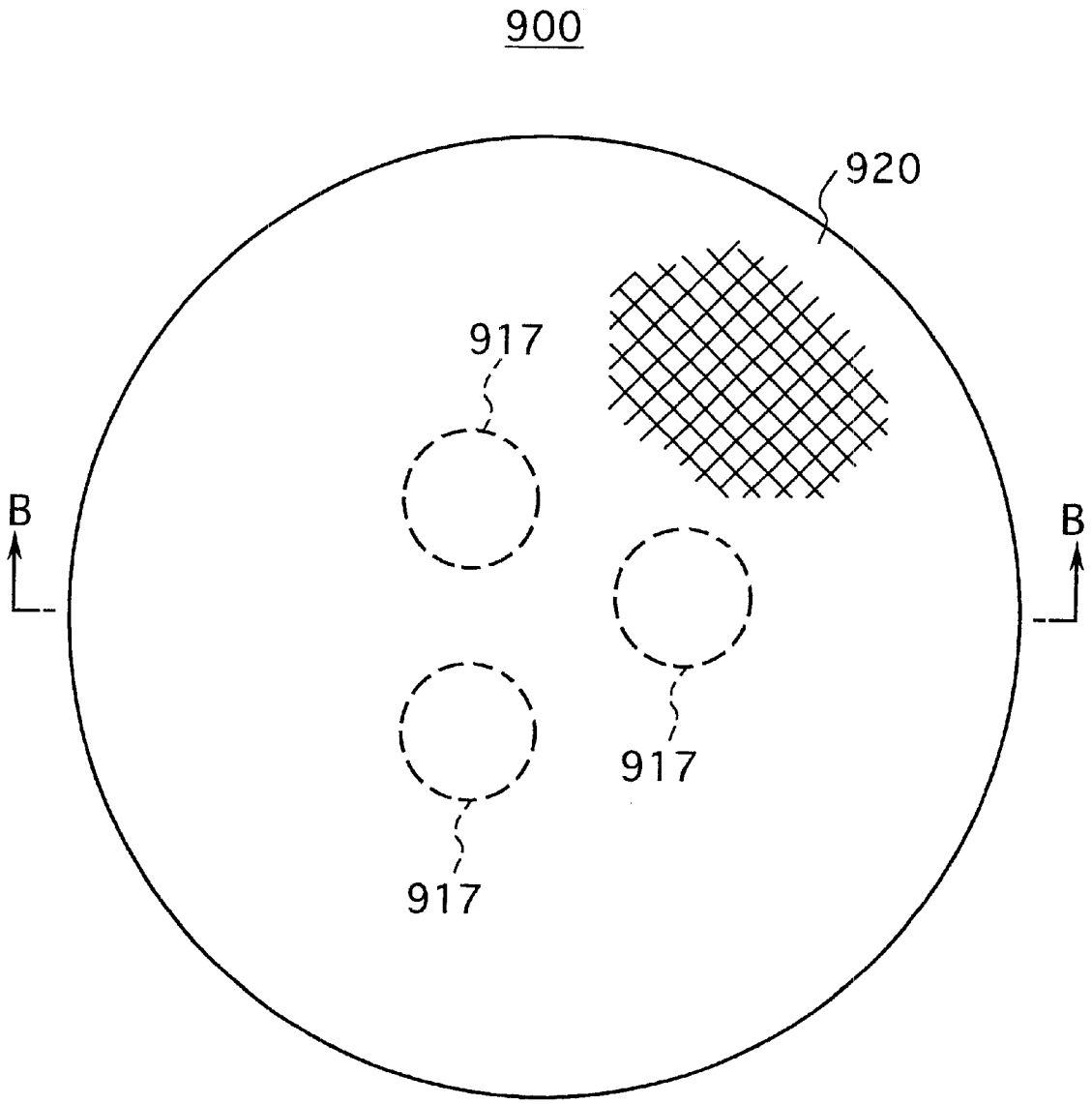
FIG. 8 PRIOR ART
FIG. 8 is a plan view of a conventional electret condenser microphone.
Figure 9:
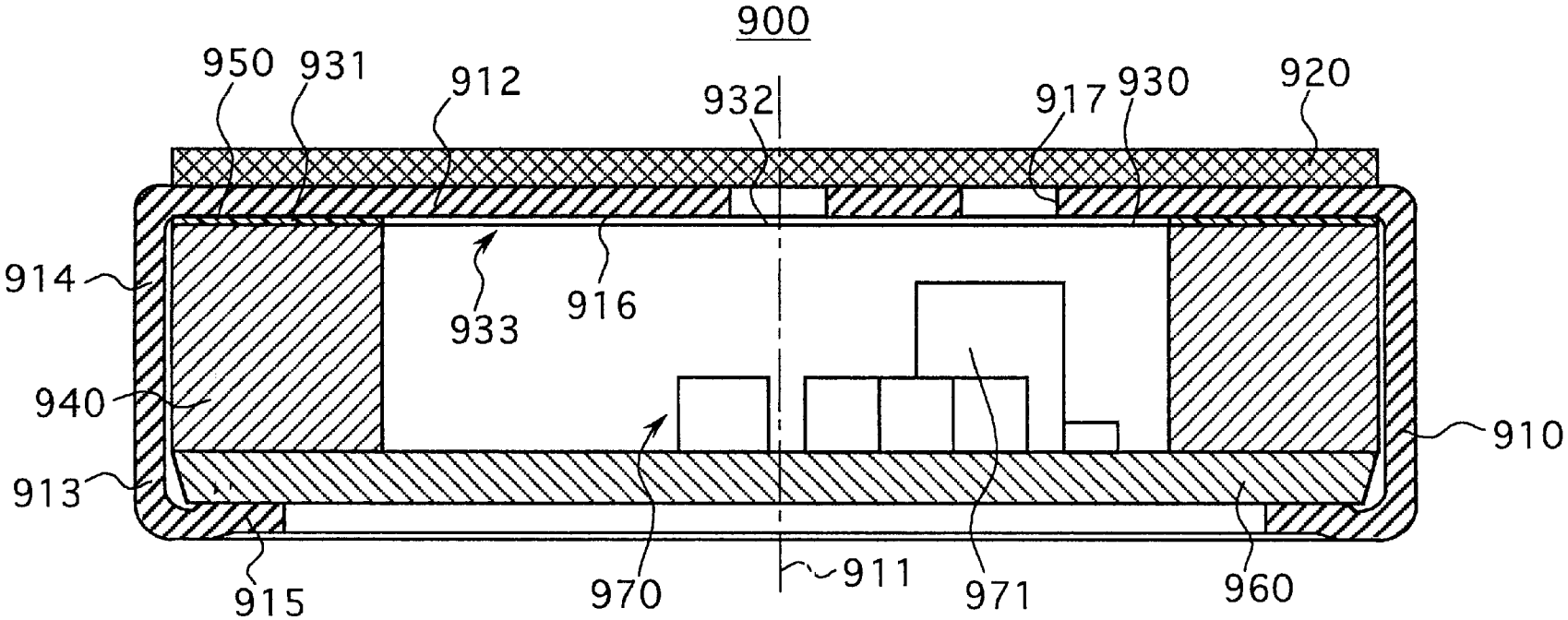
FIG. 9 PRIOR ART
FIG. 9 is a cross-sectional view taken along the line B—B of FIG. 8.
Figure 10C:
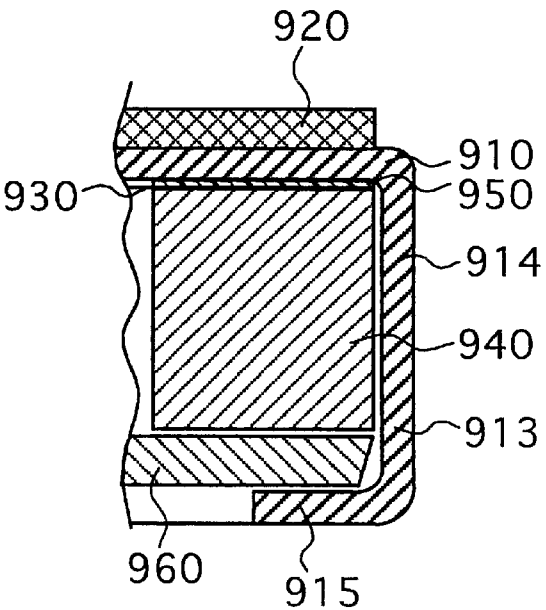
FIG. 10C PRIOR ART
FIG. 10C is an enlarged fragmentary cross-sectional view similar to FIG. 10A but showing an external force releasing step performed by the conventional electret condenser microphone shown in FIG. 9.
Figure 10B:
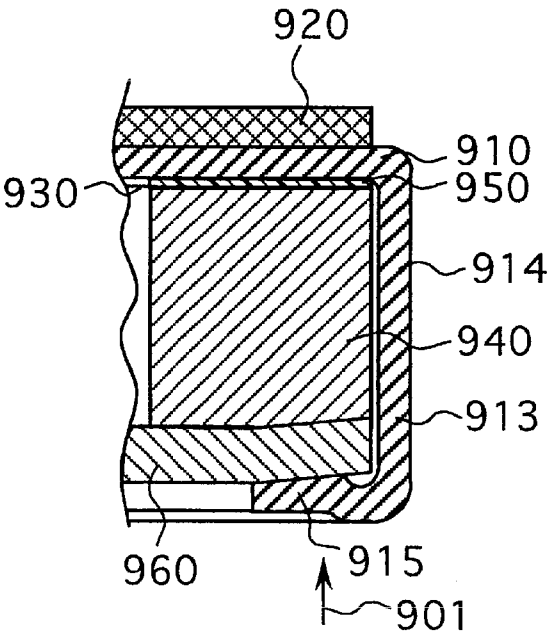
FIG. 10B PRIOR ART
FIG. 10B is an enlarged fragmentary cross-sectional view similar to FIG. 10A but showing an external force imparting step performed by the conventional electret condenser microphone shown in FIG. 9.
Figure 10A:
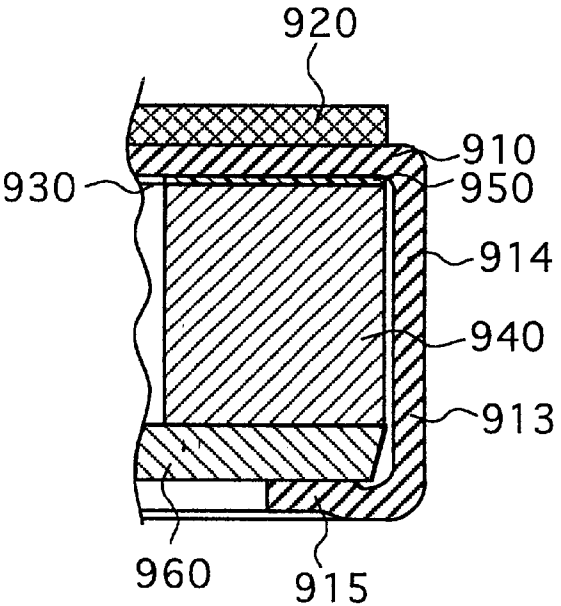
FIG. 10A PRIOR ART
FIG. 10A is an enlarged fragmentary cross-sectional view of the conventional electret condenser microphone shown in FIG. 9.

The following description will be directed to a method of producing the electret condenser microphone 300 with reference to the drawings shown in FIGS. 7A, 7B and 7C. The method of producing the electret condenser microphone 300 is performed through the steps including a preparing step, an imparting step and a releasing step as follows.

In the preparing step, the casing member 140, the printed circuit board 170, the electrically insulating member 196, the electrode plate 110, the electrically connecting member 192, the diaphragm supporting member 150, the diaphragm 120, the electrically insulating spacer 130, the covering member 160, and the signal converting unit 180 are prepared as a partially fabricated unit. The constructions of the casing member 140, the printed circuit board 170, the electrically insulating member 196, the electrode plate 110, the electrically connecting member 192, the diaphragm supporting member 150, the diaphragm 120, the electrically insulating spacer 130, the covering member 160, and the signal converting unit 180 have been described in the above as will be seen in FIG. 6. The second section 145 of the side portion 143 of the previously mentioned casing member 140, however, is straightly extends from the first section 144 of the side portion 143 of the casing member 140 before the imparting step.

In the imparting step, the second section 145 of the side portion 143 of the casing member 140 is then imparted an external force toward an imparting direction shown by an arrow 108 to assume a first state in which the second section 145 of the side portion 143 of the casing member 140 is bent toward the center axis 141 of the casing member 140 to the extent that the electrically insulating member 196 is forcibly elastically deformed along the center axis 141 of the casing member 140 with the annular groove 103 being reduced in space as shown in FIG. 7B. For the purpose of assisting in understanding, the deformations of the casing member 140, the printed circuit board 170 and the electrically insulating member 196 are illustrated in an exaggerated manner in FIG. 7B as being larger than the real deformations of the casing member 140, the printed circuit board 170 and the electrically insulating member 196.

In the releasing step, the second section 145 of the side portion 143 of the casing member 140 is then released from the external force imparted thereto toward the imparting direction shown by the arrow 108 to assume a second state in which the second section 145 of the side portion 143 of the casing member 140 is naturally elastically restored along the center axis 141 of the casing member 140 to the extent that the electrically insulating member 196 is naturally elastically restored along the center axis 141 of the casing member 140 with the annular groove 103 being restored in space as shown in FIG. 7C.

The electret condenser microphone 300 is then ideally produced to have each of the second section 145 of the side portion 143 of the casing member 140 and the electrically connecting member 192 held in contact with the printed circuit board 170 under a high contact pressure between the second section 145 of the side portion 143 of the casing member 140 and the printed circuit board 170 as shown in FIG. 7A. The fact that each of the second section 145 of the side portion 143 of the casing member 140 and the electrically connecting member 192 is held in contact with the printed circuit board 170 under the high contact pressure between the second section 145 of the side portion 143 of the casing member 140 and the printed circuit board 170 leads to the fact that each of the electrode plate 110 and the diaphragm 120 is electrically connected with the printed circuit board 170 with reliability.

As will be seen from the foregoing description, the fact that the electrically insulating member intervenes between the printed circuit board and the electrode plate to form part of the annular groove leads to the fact that the third embodiment of the electret condenser microphone according to the present invention makes it possible that each of the electrode plate and the diaphragm is electrically connected with the printed circuit board with reliability. In addition, the fact that the outer diameter of the flange portion of the electrically connecting member is less than the inner diameter of the second section of the side portion of the casing member leads to the fact that the third embodiment of the electret condenser microphone according to the present invention makes it possible that each of the electrode plate and the diaphragm is electrically connected with the printed circuit board with no deformation of the electrically connecting member.

While it has been described in the foregoing embodiment that the electrically connecting member is in the form of an annular ring shape, the electrically connecting member may be in the form of any other shape as long as the electrically connecting member can intervene between the printed circuit board and the electrode plate to have the printed circuit board and the electrode plate electrically connected with each other according to the present invention.

Though it has been described in the foregoing embodiment that the electrically insulating member is made of a resin, the electrically insulating member may be made of any,other material having a larger elasticity than a metal according to the present invention.

While the present invention has thus been shown and described with reference to the specific embodiments, however, it should be noted that the invention is not limited to the details of the illustrated structures but changes and modifications may be made without departing from the scope of the appended claims.

What is claimed is:

1. An electret condenser microphone for receiving an acoustic wave to be converted to an acoustic signal indicative of said acoustic wave, comprising:

a casing member having a center axis and including a circular acoustic inlet portion and a cylindrical side portion integrally formed with said acoustic inlet portion, said side portion of said casing member having a first section close to said acoustic inlet portion of said casing member and a second section remote from said acoustic inlet portion of said casing member, said second section of said side portion of said casing member radially inwardly bent toward said center axis of said casing member;

a printed circuit board disposed in said casing member and held in contact with said second section of said side portion of said casing member, said casing member and said printed circuit board collectively forming a cylindrical casing space;

an electrically insulating member accommodated in said casing space and provided on said printed circuit board, said electrically insulating member having an inner surface;

an electrode plate provided on said electrically insulating member; and an electrically connecting member having a peripheral surface and intervening between said printed circuit board and said electrode plate to have said printed circuit board and said electrode plate electrically connected with each other under the state that said peripheral surface of said electrically connecting member is held in contact with said inner surface of said electrically insulating member.

2. An electret condenser microphone as set forth in claim 1, in which the outer diameter of said electrically connecting member is less than the inner diameter of said second section of said side portion of said casing member.

3. An electret, condenser microphone as set forth in claim 1, in which said electrically insulating member forms part of an annular groove open toward said side portion of said casing member, in which the inner diameter of said annular groove is less than the inner diameter of said second section of said side portion of said casing member.

4. An electret condenser microphone as-set forth in claim 1, which farther comprises a diaphragm supporting member accommodated in said casing space and provided on said acoustic inlet portion of said casing member; and a diaphragm including a peripheral portion securely retained by said diaphragm supporting member and a central portion integrally formed with said peripheral portion and radially inwardly extending from said peripheral portion to be partly oscillatable with respect to said casing member, said diaphragm opposing and spaced apart from said electrode plate at a predetermined space distance.

5. An electret condenser microphone as set forth in claim 4, which further comprises an electrically insulating spacer intervening between said electrode plate and said diaphragm to have said electrode plate and said diaphragm spaced apart from each other at said predetermined space distance.

6. An electret condenser microphone as set forth in claim 4, in which said electrode plate and said diaphragm collectively constitute a condenser unit to generate an electrical capacitance corresponding to the space distance between said electrode plate and said diaphragm when said acoustic wave is transmitted to said diaphragm to have said central portion of said diaphragm partly oscillated with respect to said casing member.

7. An electret condenser microphone as set forth in claim 6, which further comprises signal converting means for converting said electrical capacitance generated by said condenser unit to said acoustic signal indicative of said acoustic wave transmitted to said diaphragm.

8. An electret condenser microphone as set forth in claim 7, in which said signal converting means includes a field effect transistor, a chip capacitor and a resistor.

9. An electret condenser microphone as set forth in claim 1, which further comprises a covering member provided on said acoustic inlet portion of said casing member.

10. An electret condenser microphone as set forth in claim 1, in which said electrode plate has thereon an electret film.

11. A method of producing an electret condenser microphone, comprising the steps of:

preparing a partially fabricated unit comprising a casing member having a center axis and including a circular acoustic inlet portion and a cylindrical side portion integrally formed with said acoustic inlet portion, said side portion of said casing member having a first section close to said acoustic inlet portion of said casing member and a second section remote from said acoustic inlet portion of said casing member, a printed circuit board disposed in said casing member and spaced apart from said acoustic inlet portion of said casing member, said casing member and said printed circuit board collectively forming a cylindrical casing space, an electrically insulating member accommodated in said casing space and provided on said printed circuit board, said electrically insulating member having an inner surface, an electrode plate provided on said electrically insulating member, an electrically connecting member having a peripheral surface and intervening between said printed circuit board and said electrode plate to have said printed circuit board and said electrode plate electrically connected with each other under the state that said peripheral surface of said electrically connecting member is held in contact with said inner surface of said electrically insulating member;

imparting an external force to said second section of said side portion of said casing member to assume a first state in which said second section of said side portion of said casing member is bent toward said center axis of said casing member to the extent that said electrically insulating member is forcibly elastically deformed along said center axis of said casing member; and releasing said second section of said side portion of said casing member from said external force imparted thereto to assume a second state in which said second section of said side portion of said casing member is naturally elastically restored along said center axis of said casing member to the extent that said electrically insulating member is naturally elastically restored along said center axis of said casing member.

12. A method of producing an electret condenser microphone as set forth in claim 11, in which said electrically insulating member is made of a resin.

* * * * *

UNITED STATES PATENT AND TRADEMARK OFFICE

CERTIFICATE OF CORRECTION

PATENT NO. : 6,512,833 B2
DATED : January 28, 2003
INVENTOR(S) : Tooru Himori et al.

It is certified that error appears in the above-identified patent and that said Letters Patent is hereby corrected as shown below:

Column 9,
Line 54, please delete “boar”, and insert therefor -- board --.

Column 14,
Line 2, please delete “10c”, and insert therefor -- 110c --.

Column 15,
Line 66, please delete “any,other”, and insert therefor -- any other --.

Column 16,
Line 30, please delete “on”, and insert therefor -- within --.
Lines 37-38, please delete “is held”, and insert therefor -- is surround and held --.
Line 50, please delete “as-set”, and insert therefor -- as set --.

Column 18,
Line 1, please delete “on”, and insert therefor -- within --.
Line 17, please delete “is bent”, and insert therefor -- is surround and bent --.

Signed and Sealed this

Twenty-sixth Day of August, 2003

JAMES E. ROGAN
*Director of the United States Patent and Trademark Office*